US006183063B1

(12) United States Patent
Bolash et al.

(10) Patent No.: US 6,183,063 B1
(45) Date of Patent: Feb. 6, 2001

(54) ANGLED PRINTER CARTRIDGE

(75) Inventors: John Philip Bolash; Michael Clark Campbell; Thomas Jon Eade, all of Lexington, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/262,766

(22) Filed: Mar. 4, 1999

(51) Int. Cl.[7] ..... B41J 2/155; B41J 2/05
(52) U.S. Cl. ..... 347/42; 347/5
(58) Field of Search ..... 347/42, 43, 65

(56) References Cited

U.S. PATENT DOCUMENTS

| | | | | |
|---|---|---|---|---|
| 4,612,554 | | 9/1986 | Poleshuk . | |
| 5,160,945 | | 11/1992 | Drake . | |
| 5,192,959 | * | 3/1993 | Drake et al. | 347/43 |
| 5,365,645 | | 11/1994 | Walker et al. . | |
| 5,440,332 | | 8/1995 | Good . | |
| 5,568,169 | * | 10/1996 | Dudek et al. | 347/43 |
| 5,619,622 | * | 4/1997 | Audi et al. | 395/108 |
| 5,638,108 | * | 6/1997 | Nacman et al. | 347/238 |

* cited by examiner

*Primary Examiner*—Thinh Nguyen
(74) *Attorney, Agent, or Firm*—Michael T. Sanderson; Luedeka, Neely & Graham

(57) ABSTRACT

The specification describes a printer containing an angled printer cartridge and a method for printing using the cartridge. The printer is an ink jet printer which includes a print media movement device for moving a print media having through the printer along a print media path and a printer cartridge attached to the printer at an angle between 0° and 90° relative to an axis perpendicular to an axis along the direction of the media path through the printer. The printer cartridge has a length sufficient to print substantially the entire width of the printed width across the print media and contains a plurality of printheads along at least a portion of the length thereof, each printhead having one or more nozzle arrays. During a printing operation, only a portion of the printheads along the length of the cartridge are activated thus, reducing power consumption during printing. Angling the printer cartridge also has the advantage of increasing the print quality without increasing the density of nozzles in the nozzle array of the printhead.

17 Claims, 5 Drawing Sheets

ANGLED PRINTER CARTRIDGE

FIELD OF THE INVENTION

The invention relates to ink jet printers and, in particular, to a printer cartridge orientation which is suitable for increased printing speeds and improved print quality.

BACKGROUND OF THE INVENTION

Ink jet printers comprise two basic types, namely, printers having movable printheads which traverse the print media and deposit ink droplets in a defined pattern on each swath of the printer cartridge and printers having substantially fixed page wide printheads which contain an array of nozzles along the length of the printhead.

In a moveable printhead design, one or more printer cartridges each containing a printhead are attached to a movable carriage which traverses the print media as the media moves transverse to the carriage movement through the printer. Use of multiple printer cartridges rather than a single cartridge attached to a movable carriage greatly increases print speed. However, in order to obtain the highest quality printing, alignment between the print cartridges is critical and is often difficult to maintain over the life of the printer. As the print cartridges are changed, slight misalignment of the cartridges occurs thereby degrading the print quality. The alignment problems associated with multiple printer cartridges are not present when using a single print cartridge, however, a single cartridge printer cannot print at the higher speeds obtainable by use of multiple printer cartridges.

In an effort to increase printer speed without sacrificing print quality, page wide printhead arrays having a length equal to, or slightly less, than the width of print media have been developed. The page wide printhead arrays are set at about 90 degrees or substantially perpendicular to the direction of travel of print media through the printer. Such large or page wide printhead arrays greatly increase the printing speeds but require a higher density of nozzles on the printhead in order to obtain the same print quality obtained by the use of a movable printhead. Moveable printheads do not suffer from lower print quality for printheads having the same nozzle density as the page wide printheads because such printheads can be moved across the print media to create a higher density of ink droplets on the media.

One disadvantage of a page wide printhead array is the difficulty associated with manufacturing such a printhead with a sufficiently high density of nozzles sufficient to produce the desired print quality. Providing a high density of nozzles on the printhead is complicated by the routing requirements for the electrical tracing to the ink ejection devices and for the ink channels and flow features on the printheads for flow of ink to the nozzle chambers adjacent each nozzle.

Another disadvantage of page wide printheads oriented perpendicular to the direction of travel of the print media is that such printheads consume excessive amounts of power because all or a significantly large percentage of the nozzles of the printhead must operate simultaneously to provide full ink coverage on the print media, such as for a fully printed page.

An object of the invention is therefore to provide an improved high speed, high quality printer.

Another object of the invention is to provide a printer having an improved page wide printhead array.

A further object of the invention is to provide a printer which improves print quality without sacrificing print speed.

Still another object of the invention is to reduce the power consumption of a page wide printhead device.

Another object of the invention is to reduce the manufacturing costs and difficulties associated with producing page wide printhead arrays.

SUMMARY OF THE INVENTION

With regard to the above and other objects, the invention provides an ink jet printer including a print media movement device for moving a print media having a printed width through the printer along a print media path and a printhead cartridge attached to the printer at an angle between 0° and 90° relative to an axis perpendicular to an axis along the direction of the media path through the printer, the cartridge having a length sufficient to print substantially the entire width of the printed width across the print media wherein the cartridge contains one or more printheads along at least a portion of the length thereof, each printhead having one or more nozzle arrays.

In another aspect the invention provides a method for printing which comprises providing a printer containing a media carriage, a print media disposed in the carriage and an elongate cartridge removably attached to the printer and disposed across the carriage at an acute angle relative to an axis perpendicular to a direction of movement of the print media through the printer, wherein the cartridge contains a plurality of printheads along at least a portion of the length thereof, each printhead containing at least one nozzle array and energizing ink imparting devices on the printhead to effect ejection of ink from the printhead in a pattern sufficient to produce indicia on the print media.

For the purposes of this invention, the "angle" means the smallest angle made by an axis along the length of the printhead relative to an axis perpendicular to path of the print media through the printer.

An advantage of the printer according to the invention is that ink droplets forming the printed indicia may be ejected from only a portion of the cartridge at a time, thereby significantly reducing power consumption yet producing a fully printed media. In a conventional printer, the page wide cartridge is disposed at an angle so that the cartridge lies substantially perpendicular to an axis along the direction of movement of the print media through the printer. Accordingly, in order to print an entire line of indicia across the print media at one time, a substantial number of nozzles along the length of the printhead must be activated or fired at the same time. Another advantage is that the angled printhead of the invention need not contain as high a density of nozzles as a similar printhead disposed perpendicular to the paper path in order to provide the same print quality.

Alternatively, the manufacturing costs for printers may be significantly reduced because the invention enables construction of a printhead having increased nozzle-to-nozzle spacing along the printhead without sacrificing print resolution. Because the invention enables production of high resolution printheads with increased nozzle spacing, it is easier and less costly to manufacture the printhead as compared to conventional printheads which are mounted substantially perpendicular to the paper path.

BRIEF DESCRIPTION OF THE DRAWINGS

Further advantages of the invention will become apparent by reference to the detailed description of preferred embodiments when considered in conjunction with the following drawings in which like reference numerals denote like elements throughout the several views, and wherein.

DETAILED DESCRIPTION OF THE INVENTION

Figure 1A:
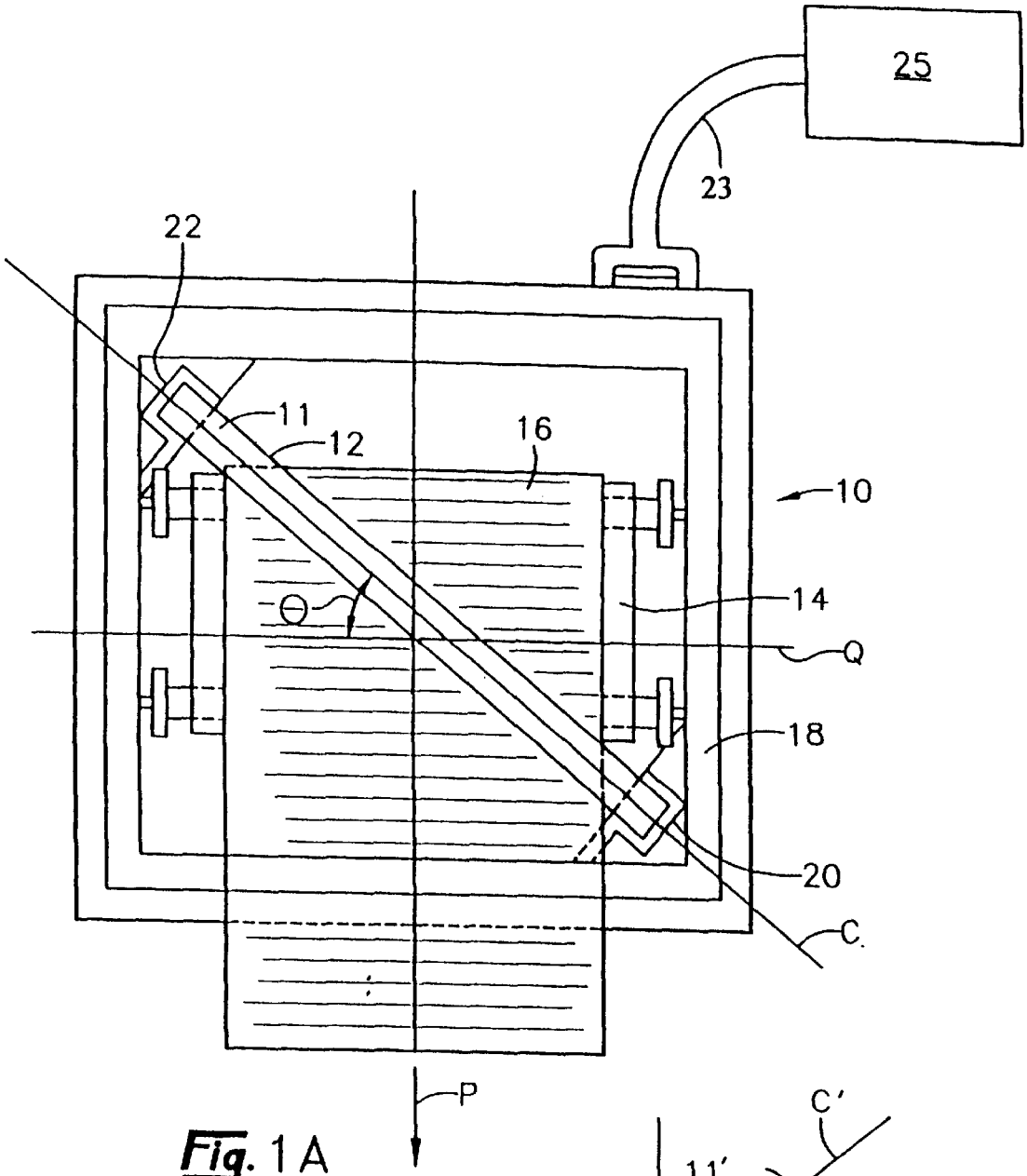
FIG. 1A is a plan top view of a printer according to the invention.

Referring now to the figures, there is shown in FIG. 1A printer 10 according to the invention. The printer 10 is preferably an ink jet printer having an elongate printer cartridge 11 containing one or more ink reservoirs in flow communication with a printhead 12 attached to the cartridge 11 and having a plurality of ink ejection devices thereon for ejecting ink onto a print media 16 to be printed, such as paper. The printer 10 further comprises a print media carriage device 14 for moving print media 16 through the printer 10 past the printer cartridge 11 in a direction along the print media path through the printer generally indicated by axis P. Axis P is perpendicular to axis Q which lies across the width of the printer.

Figure 1B:
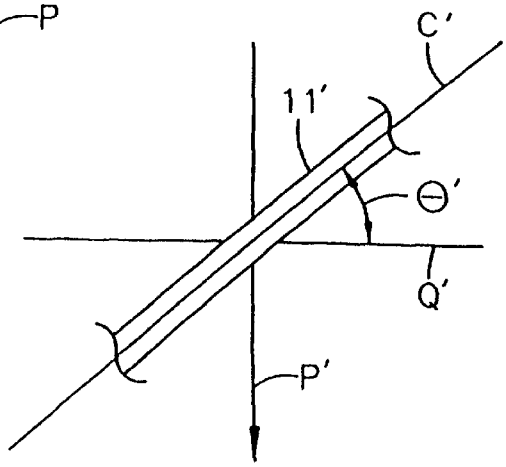
FIG. 1B is an illustration of another orientation of an angled printhead according to the invention.

As defined above, angle θ is the angle measured between axis Q and an axis C along the length of the printer cartridge 11. Angle θ preferably ranges between about 5° and about 85°, more preferably ranges from about 10° to about 60° and most preferably angle θ is about 45°. As shown in FIG. 1B, The printer cartridge 11' may lie across the printer so that axis C' along the length of the cartridge 11' makes an angle θ with respect to axis Q' lying across the width of the printer.

The cartridge 11 is preferably a "page wide" cartridge. The term "page wide" means that the cartridge is of such a length that ink may be ejected across the entire printed width of the print media without moving the cartridge across the width of the print media. The printed width across the print media may range from about 1 inch to about 8 inches or more depending on the width of the print media. A page wide cartridge is not limited to a single semiconductor substrate, nozzle plate, ink supply cartridge, etc. Accordingly, multiple semiconductor substrates, nozzle plates and ink supply cartridges may be attached to a common printhead holder in a linear array to produce the page wide printer cartridge. For purposes of simplicity, without intending to limit the invention in any way, the entire assembly containing one or more nozzle plates, semiconductor substrates and/or ink cartridges will be referred to as a page wide printer cartridge. However, it will be recognized that the invention is not intended to be limited to a pagewide cartridge as any multiple printhead cartridge may be angled relative to the axis perpendicular to the axis along the print media path in order to achieve the purposes of this invention.

The printer cartridge 11 is preferably removably attached to the frame 18 of the printer 10 by attachment devices 20 and 22. Electrical connections to the printer cartridge for activating ink ejection devices on the printhead are provided adjacent either one or both the attachment devices 20 and 22 or such electrical connections may be attached to the top of the printer cartridge between or adjacent attachment devices 20 and 22. The electrical connections may be provided by electrical contacts, flexible cables, multiple pin connections, ribbon cables, pin contact pads, spring loaded contacts and the like. Conventional connecting devices and methods are well known to those of ordinary skill in the art and may be used to provide electrical connections to the cartridge.

The printer 10 will typically also contain suitable microprocessor devices, motors, power supplies and the like for receiving input from an input device through an interface cable or printer cable 24 in order to selectively energize ink ejection devices on the cartridge 12 and for selectively moving the print media 16 through the printer 10. The interface cable or printer cable 24 may be attached between the printer 10 and a printer control device, such as computer 25 or other electrical impulse generating device.

Figure 2A:
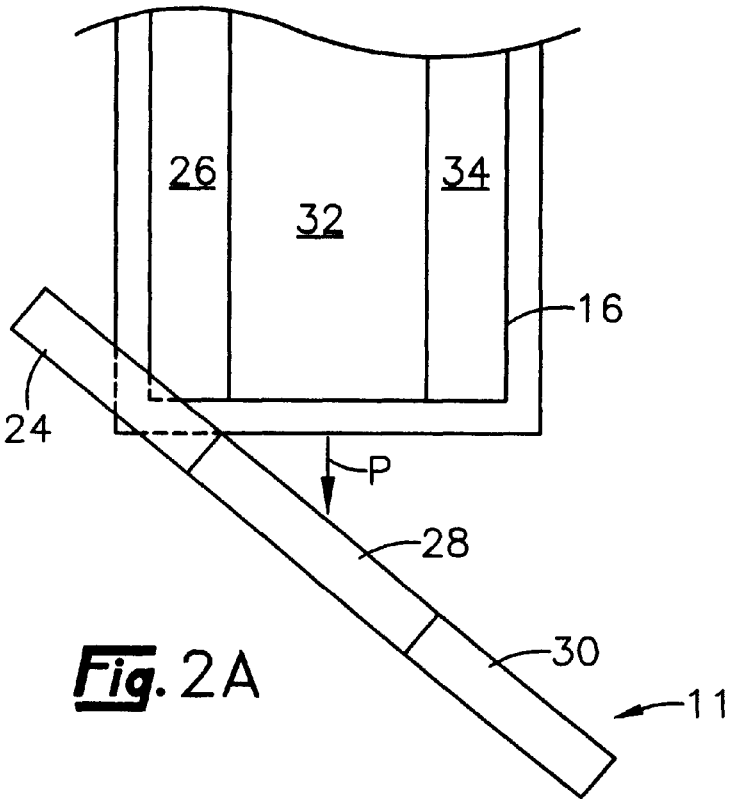
FIGS. 2A and 2B are illustrations of sequential printing on a print media using a printer or cartridge according to the invention.
Figure 2B:
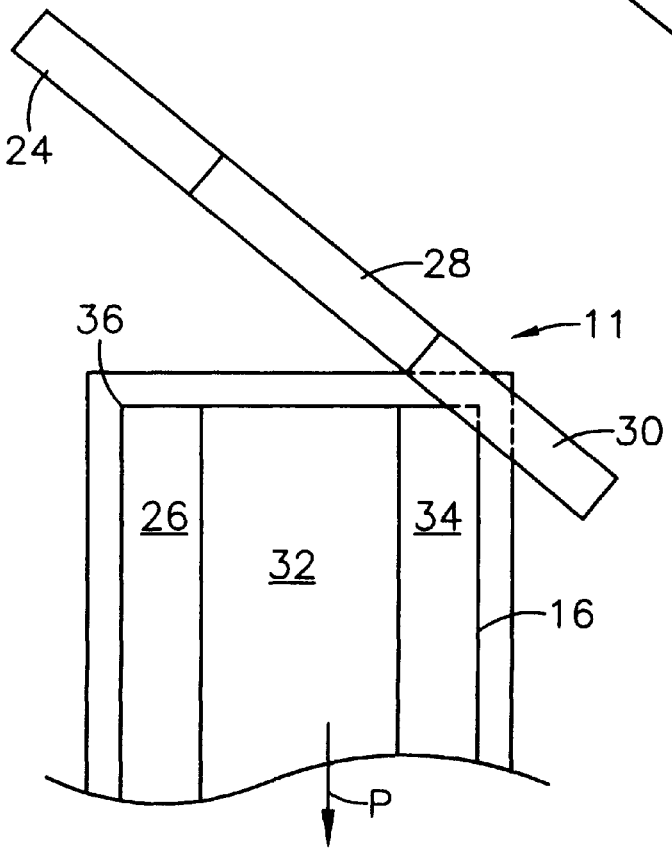

The sequential operation of an angled printer cartridge 11 is illustrated generally by FIGS. 2A and 2B. For illustrative purposes only, the cartridge 11 is divided into three sections 24, 28 and 30. However, it will be recognized that more or fewer sections may be used and the sections may be controlled individually as the print media 16 moves through the printer 10 relative to the fixed printer cartridge 11. With reference to FIG. 2A, as the print media 16 moves past the cartridge 11, a portion 26 of the media 16 directly adjacent section 24 of the cartridge 11 is printed upon activation of ink ejection devices on the printhead 12 in section 24 of the cartridge 11. Because the print media is adjacent only section 24 at this point in time, only this section of the cartridge 11 is activated while sections 28 and 30 remain inactivated.

As the print media 16 moves adjacent the sections 28 and 30 of the printer cartridge 11, the corresponding ink ejection devices in these sections are preferably activated in succession to print in areas 32 and 34 of the print media 16. Once the top of printed portion 36 of the print media 16 has cleared section 24, the printhead in this section of the cartridge 11 need no longer be activated. Accordingly, it can be seen much of the time printing the page that only a portion of the ink ejection devices on the printhead 12 are activated as the print media 16 is moving adjacent the printer cartridge 11. Accordingly, the peak power consumption for the printer 10 is more distributed and is on average lower than the power consumption for a printer having a cartridge substantially perpendicular to the direction of travel of the print media through the printer.

Figure 3A:
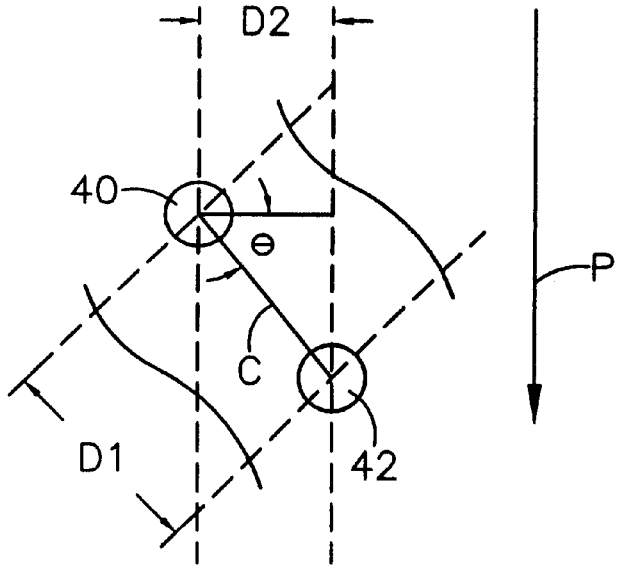
FIG. 3A is an illustration of nozzle spacing between two nozzles on an angled printhead.

An important advantage obtained by angling the printhead 12 in the printer 10 is that for a given resolution, the spacing D1 between individual nozzle holes 40 and 42 may be increased as compared to the spacing required for the same resolution for a page wide printer cartridge which is aligned substantially perpendicular to the path of paper through the printer. This nozzle spacing advantage obtained by the cartridge arrangement according to the invention is illustrated graphically in FIG. 3A. Printer resolution is determined by the following equation $$D2=D1*\cos\theta$$

where D1 is the spacing between adjacent nozzle holes 40 and 42 along the axis C of the printhead, D2 is the resultant horizontal distance between two adjacent dots printed on the print media by nozzles 40 and 42. The reciprocal of D2 is the resolution of the printer in dots per inch (dpi).

In a conventional printer using a page wide printhead, the distance between nozzle holes 40 and 42 is still D1 but angle θ is zero. Thus D2 is equal to D1 and the print resolution is determined directly by D1. In order to increase the resolution of a conventional printer the spacing D1 must be decreased proportionately with the desired resolution increase. However, decreasing the nozzle hole spacing D1 increases the complexity required to produce the nozzle arrays, flow features and electrical components required for printer operation. In order to assure the integrity of the ink chamber walls and flow channels for directing ink to the respective nozzle holes, the walls of the chambers and channels are made as thick as possible. As the nozzle holes and corresponding chambers and channels are spaced closer together, the wall thicknesses must be reduced accordingly. An advantage of greater allowable nozzle hole spacing D1 is that the wall thickness for the flow features may be increased thereby increasing the integrity and reliability of the printhead, or at the very least, enables the printhead to be manufactured with the minimum acceptable wall thickness for the flow features.

For angles θ of between 0° and 90°, D2 is less than D1. Hence, the value of D2 may be changed by changing the angle θ of the printhead 12 relative to the axis Q which is perpendicular to the movement path P of print media 16 through the printer 10. A preferred angle for the printhead 12 ranges from about 10° to about 60° with an angle of about 45° being particularly preferred. By way of example, for a 600 dpi printer, the distance D1 may range from about 0.002 inch to about 0.003 inch (i.e., θ=about 30° to about 60°) as compared to about 0.0016 inch for a printhead arranged perpendicular to a print media path P (i.e., θ=0°) and having the same 600 dpi resolution. A preferred resolution is about 1/600 inch, but may range from about 1/300 to about 1/2400 inch.

Angling the page wide printhead 12 has the added benefit of decreasing the percentage effect of fixed manufacturing tolerances in distance D1 that are reflected into the effective nozzle spacing D2 which determines the resolution of the printer 10. These tolerances may be the typical process tolerances that result from forming the features in the thick and thin films used to provide the thermal ink jet flow channels and nozzles of the printhead, or the increased tolerances may be the result of providing a long page wide printhead array by arranging smaller thermal ink jet printhead chips linearly along the page wide array rather than providing a single long chip. If the page wide array is made up of individual chips, a tolerance is created in the distance D1 that depends on how accurately the manufacturing process can merge these smaller chips into a single long page wide printhead array.

Figure 3B:
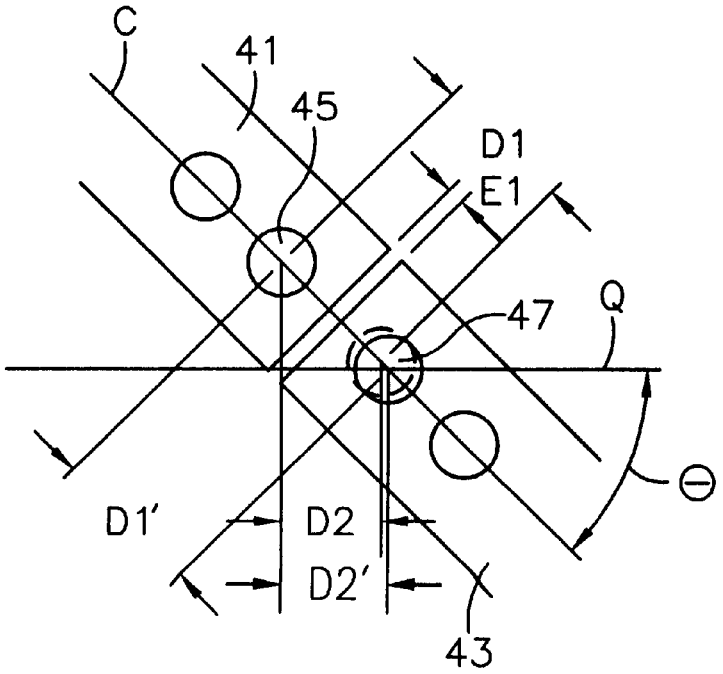
FIG. 3B illustrates manufacturing tolerance errors between individual chips linearly assembled to provide an angled printhead.

FIG. 3B illustrates manufacturing tolerance advantages provided by an angled printhead arrangement when using individual chips arranged linearly to provide a single page wide printhead cartridge 11. In FIG. 3B, printheads 41 and 43 are spaced apart an error distance E1 resulting in a distance between adjacent nozzle holes 45 and 47 of D1' instead of the preferred D1 wherein D1'=D1 +E1. The resulting horizontal positioning error, e, caused by error distance E1 is significantly less than the error distance E1 itself because of the relationships D2'=D1* cos θ=D1*cos θ+E1*cos θ=D2+E1*cos θ and where D2=D1*cos θ.

For example, there is a fixed overall manufacturing process error for distance D1 (shown in FIG. 3B), called error distance E1, such that the nozzle spacing resulting after processing is D1+/−E1. If the page wide printhead 12 is not angled, (i.e. θ=0) then the base distance that determines printer resolution, D2, is equal to D1 (i.e., D2=D1 and cos θ=1). The horizontal positioning error, e, for distance D2 is thus the same as the error for D1 (i.e., E1) since D1 and D2 are equal and therefore the error in print resolution is determined directly by distance D1 and its associated error distance E1.

However, if the page wide printhead 12 is angled, for example at 45°, then the fixed process error in D1, E1, is reduced by the cosign of θ thereby reducing the error, e, in distance D2. The resulting error in D2, instead of being D2+/−E1, as it is with an unangled printhead, now becomes D2+/−(E1*cos θ). Thus for a θ=45°, the error, e, in D2 becomes D2+/−0.707E1, which provides a reduction of about 30% in the tolerance on D2, the critical distance determining print resolution.

The increased spacing between the nozzle arrays also reduces the difficulty of producing a printhead 12 having a sufficient nozzle density for the desired print quality or print resolution. The production yield of useable printheads 12 is related to the accuracy achieved in forming the flow features and nozzle holes in the thick film and for depositing the electrical tracing and energizing devices on the semiconductor substrate.

As shown in FIG. 1A, the length of the printer cartridge 11 is substantially greater than the width of the print media 16. As the angle of the printer cartridge 11 is increased between 0° and 90°, the length of the cartridge 11 must also be increased to adequately span desired printed width of the print media 16. For example, for the preferred cartridge angle of about 45°, a cartridge length of from about 9 inches to about 19 inches is preferred in order to provide print across a substantial portion of a print media 16 having a maximum width of 8.5 inches.

Increased nozzle spacing D1 for a printhead 12 provides more room for routing electrical tracing to ink ejection devices on the silicon substrate and for routing the ink flow distribution channels for the flow of ink to the individual ink chambers on the printhead 12. A typical ink jet printhead 12 includes a plurality of nozzles, ink chambers, ink inlet channels and ink flow channels for directing ink to the energy imparting devices on a semiconductor substrate. The ink chambers and ink flow channels are typically formed in a thick film material with is attached to or integral with a nozzle plate which contains the nozzle holes.

Figure 4A:
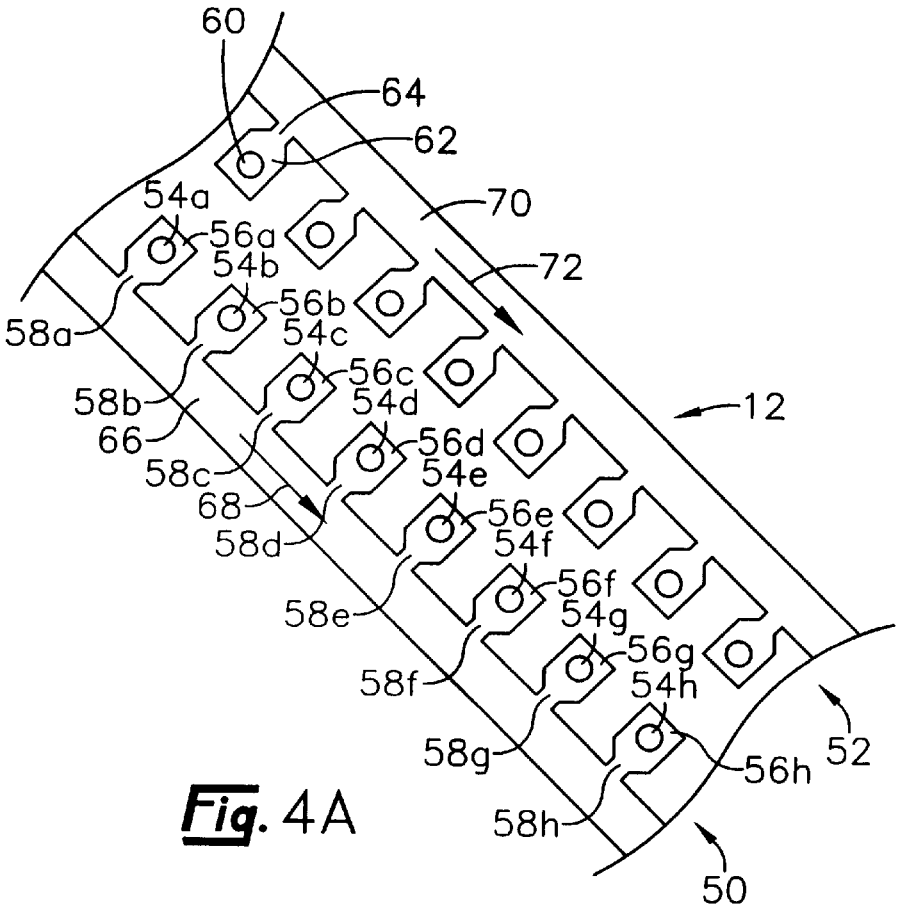
FIGS. 4A and 4B are illustrations of ink flow features of an angled printhead according to the invention.
Figure 4B:
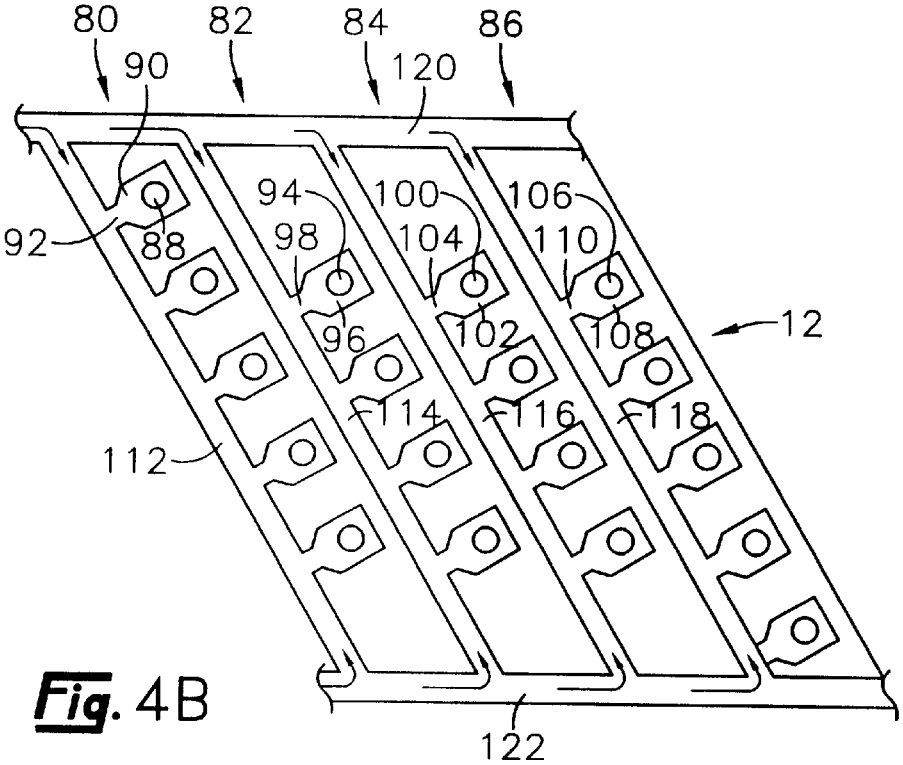

Views from the substrate side thereof of the flow features formed in thick film materials of printhead 12 made according to the invention are given in FIGS. 4A and 4B. As shown in FIG. 4A, the printhead 12 contains two nozzle arrays 50 and 52. Nozzle array 50 contains nozzle holes 54*a*–54*h*, etc., associated ink chambers 56*a*–56*h*, etc., and ink inlet channels 58*a*–58*h*, etc. Likewise, array 52 contains nozzle holes such as nozzle hole 60, ink chambers such as ink chamber 62, and ink inlet channels such as channel 64. Ink flows to each ink inlet channel 58 and each ink chamber 56 through flow path 66 in a direction generally indicated by arrow 68, and ink flows to each ink inlet channel 64 and each ink chamber 62 through flow path 70 in a direction indicated by arrow 72. The flow directions 68 and 72 are shown for illustrative purposes only and may be reversed or may be opposite to one another in order to provide efficient ink flow to the nozzles in each array.

The arrangement shown in FIG. 4A is for a side edge feed configuration wherein ink enters flow paths 66 and 70 by flowing around the outside edges of the semiconductor substrate. For a center feed configuration, the flow paths 66 and 70 would be between nozzle arrays 50 and 52. The ink would enter the flow paths 66 and 70 from a central via in the semiconductor substrate.

An alternative nozzle arrangement is illustrated in FIG. 4B. As shown, the printhead 12 contains four nozzle arrays, namely 80, 82, 84 and 86. Array 80 contains nozzle holes such as nozzle hole 88, ink chambers such as ink chamber 90 and ink inlet channels such as inlet channel 92. Array 82 contains nozzle holes such as nozzle hole 94, ink chambers such as ink chamber 96 and ink inlet channels such as inlet channel 98. Array 84 contains similar nozzles 100, ink chambers 102 and ink inlet channels 104 and array 86 contains similar nozzles 106, ink chambers 108 and ink inlet channels 110. The ink inlet channels 92 of array 80 are adjacent ink distribution channel 112. Ink distribution channels 114, 116 and 118 feed the ink inlet channels such as 98, 104 and 110 of arrays 82, 84 and 86, respectively. One or more ink supply channels 120 and 122 provide ink from an ink reservoir to the ink distribution channels 112, 114, 116 and 118. Accordingly, because the nozzles need not be spaced as close together as a printhead arranged substantially perpendicular to the direction of media movement through the printer as described with reference to FIG. 3A, there is room on the printhead 12 to locate additional ink flow paths as illustrated by FIG. 4B.

Figure 5:
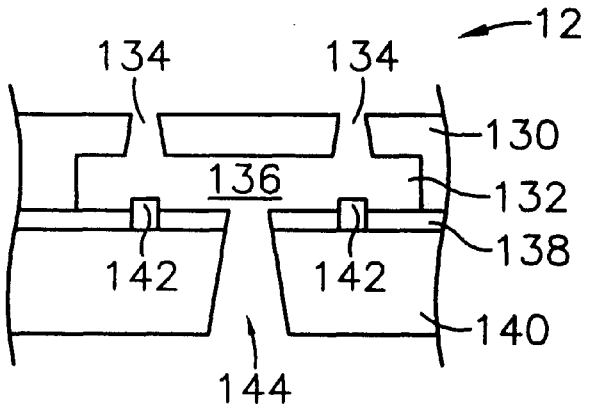
FIG. 5 is a cross-sectional view, not to scale, of a portion of a printhead according to the invention.

The ink flow to the printhead 12 comes from one or more ink reservoirs attached to the printer cartridge 11. The ink may flow through the semiconductor substrate or around the edges of the substrate or through a central ink via so that it enters the ink flow channels and ink chambers of the printhead 12. A cross-sectional view, not to scale of a portion of a printhead 12 showing the nozzle plate/thick film 130 containing the ink chambers 132, nozzle holes 134 and ink inlet channels 136 for a central ink feed arrangement is given in FIG. 5.

The nozzle plate and thick film 130 is preferably provided by a polyimide polymer tape composite material with an adhesive layer on one side thereof, the composite material having a total thickness ranging from about 15 microns to about 200 microns, with such composite materials being generally referred to as "Coverlay" in the industry. Suitable composite materials include materials available from DuPont Corporation of Wilmington, Delaware under the trade name PYRALUX and from Rogers Corporation of Chandler, Arizona under the trade name R-FLEX. However, it will be understood that the provision of nozzle holes and heaters in accordance with the present invention is applicable to nozzle plates of virtually any material including also, but not limited to, metal and metal coated plastic.

In order to form the flow features in the material of the nozzle plate/thick film 130, the material is preferably laser ablated using a mask according to well known laser ablation techniques. As a result of laser ablating the nozzle plate/thick film 130, the nozzle hole 134 preferably has tapered walls moving from ink chamber 132 to the top surface of the nozzle plate/thick film 130, the entrance opening being preferably from about 5 $\mu$m to about 80 $\mu$m in width and the exit opening being from about 5 $\mu$m to about 80 $\mu$m in width. Each ink chamber 132 and channel 136, one each of which feeds a nozzle, is sized to provide a desired amount of ink to each nozzle, which volume is preferably from about 1 picoliters (pl) to about 200 picoliters. In this regard, each ink chamber 132 preferably has a volume of from about 1 pl to about 400 pl and each channel 136 preferably has a flow area of from about 20 $\mu m^2$ to about 1000 $\mu m^2$.

Nozzle plate/thick film 130 is attached, typically with a B-stageable adhesive 138 to a semiconductor substrate 140. B-stageable thermal cure resins which may be used as adhesives 138 include, but not limited to, phenolic resins, resorcinol resins, urea resins, epoxy resins, ethylene-urea resins, furane resins, polyurethane resins and silicon resins. The thickness of the adhesive layer preferably ranges from about 1 micron to about 25 microns.

The semiconductor substrate is made of silicon and contains energy imparting devices such as resistors 142 diffused into the silicon adjacent the nozzle holes 134 in the nozzle plate thick film 130. The silicon member 140 has a size typically ranging from about 2 millimeters to about 8 millimeters wide with a length ranging from about 6 millimeters to about 26 millimeters long and from about 0.3 millimeter to about 1.2 millimeters in thickness and most preferably from about 0.5 millimeters to about 0.8 millimeters thick.

The ink travels generally by gravity and capillary action from an ink reservoir around the perimeter of the silicon member 140 or through a central via 144 in the silicon member into the channel 136 for passage into the ink chambers 132. The relatively small size of each nozzle hole 134 maintains the ink within its associated chamber 132 until activation of a heater 142 associated with the chamber 132 which vaporizes a volatile component in the ink and voids the chamber 132 after which it refills again by capillary action.

A plurality of nozzles are disposed in the printhead 12 and each of the nozzles are spaced a set distance from at least one other of the plurality of nozzles and are for transferring ink to the print media 16 while the print media is traveling through the printer 10.

At least one ink channel 136 is in fluid flow communication with each of the plurality of nozzle holes 134. Each of the ink channels 136 is spaced from at least one other ink channel equal to the set distance between each of the plurality of nozzle holes 134 from at least one other of the plurality of nozzle holes. Furthermore, each of the conductors is spaced from at least one other conductor equal to the set distance between each of the plurality of nozzle holes 134 from at least another of the plurality of nozzle holes.

Because of the length of the printer cartridge 11, the cartridge contains a plurality of individual semiconductor substrates 140 and nozzle plates/thick films 130 attached thereto. The cartridge 11 according to the invention may contain from about 1 to about 60 semiconductor substrates and corresponding nozzle plates/thick films 130. The number and spacing of nozzle holes 134 on the nozzle plates is selected to provide the desired print quality. Accordingly, for a printer resolution of 600 dpi, each individual silicon substrate 140 having a length of about 14.5 mm and a width of about 4.0 mm is preferably attached to a nozzle plate/thick film 130 containing two nozzle arrays spaced apart about 804 $\mu$m, with 304 nozzles per array. In the alternative embodiment shown in FIG. 4B, the nozzle plate/thick film 130 preferably contains four nozzle arrays spaced apart about 240 microns, with five nozzles per array.

For color printing applications, the nozzle array structures shown in FIGS. 4A and 4B are repeated for each different color. The color arrays are aligned substantially parallel to one another as graphically illustrated in FIG. 6. A color printer cartridge 200 according to the invention may contain a cyan array structure 210, a magenta array structure 212, a yellow array structure 214 and a black array structure 216. Each of the array structures 210–216 may be configured as shown generally by FIGS. 4A and 4B with either central ink feed or side ink feed arrangements. In all other respects the color cartridge 200 is similar to a single color cartridge described above.

Figure 6:
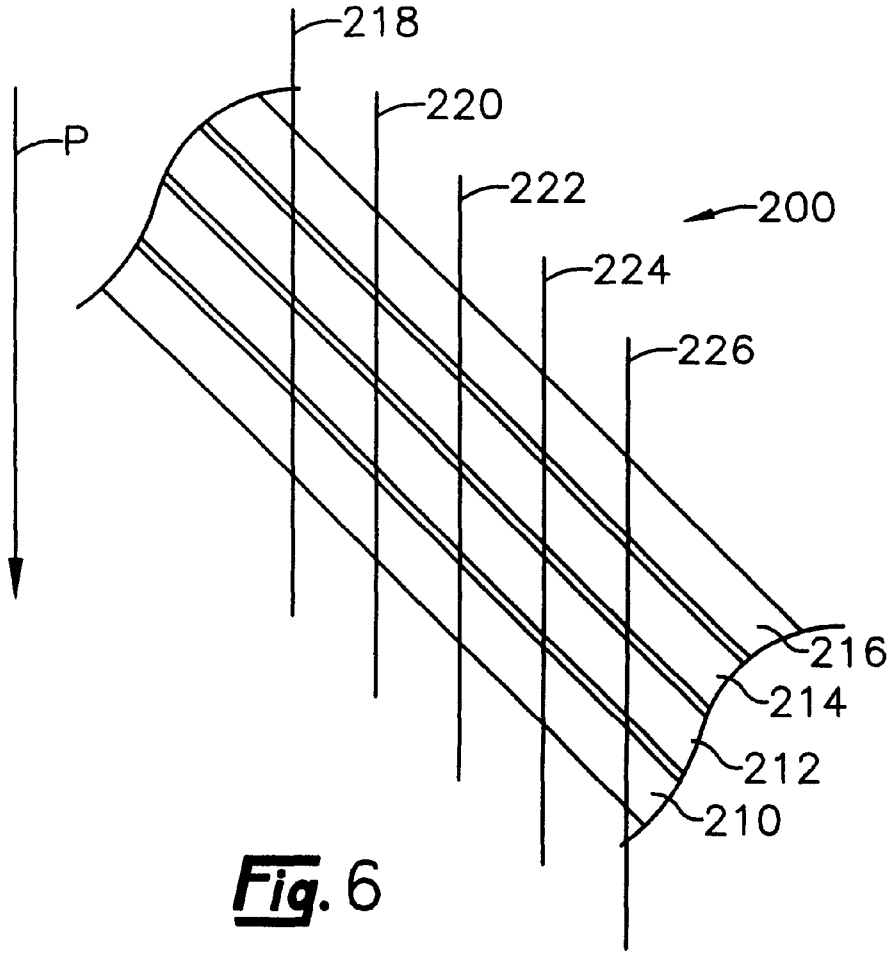
FIG. 6 is a plan view of a multi-color printer cartridge arrangement for an angled printer cartridge according to the invention.

With the parallel arrays shown in FIG. 6, lines 218–226 parallel to the path P of travel of the print media through the printer intersect all four color arrays so that full color print may be produced. However, in order to assure that all four color arrays provide color printing across the width of the paper, the printer may require a larger frame 18 (FIG. 1) than required for a printer which only uses a single color cartridge.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink jet printer including a print media movement device for moving a print media having a printed width through the printer along a print media path and a printhead cartridge attached to the printer at an angle ranging from about 5° to about 85° relative to an axis perpendicular to an axis along the direction of the media path through the printer, the cartridge having a length sufficient to print substantially the entire width of the printed width across the print media wherein the cartridge contains one or more printheads along at least a portion of the length thereof, each printhead having at least two nozzle arrays and at least one ink distribution channel adjacent each nozzle array.

2. The printer of claim 1 wherein the cartridge is attached to the printer at an angle of from about 10° to about 60° relative to the axis perpendicular to the axis along the direction of the print media path through the printer.

3. The printer of claim 1 wherein each nozzle of the nozzle array is spaced apart from an adjacent nozzle a distance ranging from about 0.002 inch to about 0.003 inch.

4. The printer of claim 1 wherein each nozzle array contains spaced apart nozzles and each nozzle is spaced from an adjacent nozzle in the array a distance ranging from about 0.0004 inch to about 0.01 inch.

5. The printer of claim 1 wherein the printer cartridge has a length ranging from about 9 inches to about 19 inches.

6. The printer of claim 1 wherein each printhead contains at least four nozzle arrays and at least four ink distribution channels adjacent the nozzle arrays.

7. The printer of claim 1 further comprising electrical connections connecting the printer cartridge to the printer disposed at both ends of the printer cartridge.

8. The printer of claim 1 further comprising three or four parallel printhead cartridges containing one or more printheads along the length of the cartridge for depositing multi-color indicia on the print media.

9. A method for printing which comprises providing a printer containing a media carriage, a print media disposed in the carriage and an elongate cartridge removably attached to the printer and disposed across the carriage at an acute angle ranging from about 5° to about 85° relative to an axis perpendicular to a direction of movement of the print media through the printer, wherein the cartridge contains a plurality of printheads along at least a portion of the length thereof, each printhead containing at least two nozzle arrays, at least one ink distribution channel adjacent each nozzle array and energizing ink imparting devices on the printhead to effect ejection of ink from the printhead in a pattern sufficient to produce indicia on the print media.

10. The method of claim 9 wherein the printer cartridge contains a plurality of printheads, further comprising the step of activating one or more printheads in succession along the length of the printer cartridge.

11. The method of claim 9 wherein the cartridge is attached to the printer at an acute angle ranging from about 10° to about 60° relative to the axis perpendicular to the direction of movement of the print media through the printer.

12. The method of claim 9 wherein each nozzle of the nozzle array is spaced apart from an adjacent nozzle a distance ranging from about 0.0004 to about 0.01 inch.

13. The method of claim 9 wherein each nozzle array contains spaced apart nozzles and each nozzle is spaced from an adjacent nozzle in the array a distance ranging from about 0.0004 inch to about 0.01 inch.

14. The method of claim 9 wherein the printer cartridge has a length ranging from about 9 inches to about 19 inches.

15. The method of claim 9 wherein each printhead contains at least four nozzle arrays and at least four ink distribution channels adjacent the nozzle arrays.

16. The method of claim 9 further comprising electrical connections connecting the printer cartridge to the printer disposed at both ends of the printer cartridge.

17. The method of claim 9 wherein the printer further comprises three or four parallel printhead cartridges containing one or more printheads along the length of the cartridge for depositing multi-color indicia on the print media as the media moves through the printer.

* * * * *